US009206371B2

(12) United States Patent
Fujinami et al.

(10) Patent No.: US 9,206,371 B2
(45) Date of Patent: Dec. 8, 2015

(54) BEARING GREASE

(75) Inventors: Yukitoshi Fujinami, Ichihara (JP); Fumihiko Yokoyama, Koto-ku (JP)

(73) Assignees: IDEMITSU KOSAN CO., LTD., Tokyo (JP); IHI Corporation, Tokyo (JP)

( * ) Notice: Subject to any disclaimer, the term of this patent is extended or adjusted under 35 U.S.C. 154(b) by 0 days.

(21) Appl. No.: 14/122,849

(22) PCT Filed: May 31, 2012

(86) PCT No.: PCT/JP2012/064121

§ 371 (c)(1),
(2), (4) Date: Nov. 27, 2013

(87) PCT Pub. No.: WO2012/165562

PCT Pub. Date: Dec. 6, 2012

(65) Prior Publication Data

US 2014/0121144 A1 May 1, 2014

(30) Foreign Application Priority Data

May 31, 2011 (JP) ..... 2011-122383

(51) Int. Cl.
*C10M 169/04* (2006.01)
*F16C 33/20* (2006.01)
(Continued)

(52) U.S. Cl.
CPC ..... *C10M 115/08* (2013.01); *C10M 105/42* (2013.01); *C10M 169/02* (2013.01); *C10M 2205/0285* (2013.01); *C10M 2207/123* (2013.01); *C10M 2207/127* (2013.01);
(Continued)

(58) Field of Classification Search
CPC ..... C10M 2215/1026; C10M 171/008; C10M 2211/06; C10M 2211/024; C09K 5/045
USPC ..... 508/106, 481, 517, 552, 579, 558; 252/67, 68
See application file for complete search history.

(56) References Cited

U.S. PATENT DOCUMENTS 5,728,659 A 3/1998 Naka et al.
6,020,290 A 2/2000 Takata et al.
(Continued)

FOREIGN PATENT DOCUMENTS

CN 1922295 A 2/2007
CN 101983294 3/2011
(Continued)

OTHER PUBLICATIONS

International Search Report Issued Jul. 24, 2012 in PCT/JP12/064121 Filed May 31, 2012.
(Continued)

*Primary Examiner* — Vishal Vasisth
(74) *Attorney, Agent, or Firm* — Oblon, McClelland, Maier & Neustadt, L.L.P.

(57) ABSTRACT

A bearing grease contains a base oil and a thickener. The base oil is a base oil mixture containing a polyalphaolefin and an ester. The bearing grease is used in an atmosphere of a fluorine compound refrigerant containing no hydrogen. A bearing using the bearing grease does not cause elution of grease for a long time. Further, since there is no need for a collecting system unlike lubricating oil, the arrangement around the bearing can be made compact. Thus, the bearing can be easily applied in a form of an energy recovery equipment to a vehicle or various industrial machineries.

9 Claims, 3 Drawing Sheets

(51) Int. Cl.

| | |
|---|---|
| ***C10M 173/02*** | (2006.01) |
| ***C10M 115/08*** | (2006.01) |
| ***C10M 171/00*** | (2006.01) |
| ***C09K 5/00*** | (2006.01) |
| ***C10M 169/02*** | (2006.01) |
| ***C10M 105/42*** | (2006.01) |

(52) U.S. Cl.

CPC ..... *C10M2207/2805* (2013.01); *C10M 2207/2835* (2013.01); *C10M 2207/2845* (2013.01); *C10M 2215/064* (2013.01); *C10M 2215/1026* (2013.01); *C10N 2230/06* (2013.01); *C10N 2230/70* (2013.01); *C10N 2240/02* (2013.01); *C10N 2240/30* (2013.01); *C10N 2250/10* (2013.01)

(56) References Cited

U.S. PATENT DOCUMENTS

| | | | | |
|---|---|---|---|---|
| 6,056,072 | A | 5/2000 | Koltermann et al. | |
| 6,172,013 | B1 | 1/2001 | Holt et al. | |
| 2005/0166607 | A1 | 8/2005 | Brasz et al. | |
| 2008/0166080 | A1 | 7/2008 | Kawamura | |
| 2008/0234150 | A1 | 9/2008 | Kakizaki et al. | |
| 2010/0108936 | A1* | 5/2010 | Kaneko | 252/68 |
| 2010/0186410 | A1 | 7/2010 | Cogswell et al. | |
| 2011/0037016 | A1* | 2/2011 | Singh et al. | 252/67 |

FOREIGN PATENT DOCUMENTS

| | | | |
|---|---|---|---|
| EP | 2 762 554 | A1 | 8/2014 |
| JP | 1-279117 | A | 11/1989 |
| JP | 05 5491 | | 1/1993 |
| JP | 2001 207185 | | 7/2001 |
| JP | 2006 77119 | | 3/2006 |
| JP | 2006 225519 | | 8/2006 |
| JP | 2007 520662 | | 7/2007 |
| JP | 2008 239815 | | 10/2008 |
| JP | 2008 247995 | | 10/2008 |
| JP | 2010 090285 | | 4/2010 |
| JP | 2011 503405 | | 1/2011 |
| JP | 2011 84646 | | 4/2011 |

OTHER PUBLICATIONS

U.S. Appl. No. 13/976,659, filed Jul. 3, 2013, Fujinami, et al.
Office Action issued on Oct. 27, 2014 in the corresponding Chinese Patent Application No. 201280025881.1 (with English Translation and Translation of Category of Cited Documents).
Extended European Search Report issued on Dec. 17, 2014 in the corresponding European Application No. 12792433.0.
Office Action Issued Jul. 10, 2015, in Chinese Patent Application No. 201280025881.1.

* cited by examiner

BEARING GREASE

This application is a 371 of PCT/JP2012/064121, filed May 31, 2012.

TECHNICAL FIELD

The present invention relates to a bearing grease used in a fluorine compound refrigerant atmosphere.

BACKGROUND ART

Turbomachines are operated at a high speed. Accordingly, in order to cool the turbomachines or keep lubricity in the turbomachines, lubricating oil is typically used for lubricating bearings of the turbomachines. When a high-speed bearing is used in an atmosphere of refrigerant as in a refrigeration cycle and a Rankine cycle, an appropriate lubricating oil designed expecting viscosity reduction due to the atmospheric gas is typically used.

In such a refrigeration cycle and Rankine cycle, a lubrication in a fluorine compound refrigerant atmosphere (liquid refrigerant lubrication) is typically applied. Examples of the lubricating oil (base oil) suitable for the liquid refrigerant lubrication are base oils compatible with the refrigerant such as a polyoxyalkylene glycol, ester, polyvinyl ether and alkylbenzene (see, for instance, Patent Literatures 1 and 2).

On the other hand, the use of grease-lubricated bearing by grease under the liquid refrigerant lubrication can simplify a circulation system of the lubricating oil and a separator for separating the refrigerant and the lubricating oil and is advantageous in terms of size and weight reduction and improvement in efficiency. However, when grease-lubricated bearing is used in a refrigerant atmosphere, the grease is washed to be removed (eluted). Accordingly, it has been believed to be extremely difficult to perform grease lubrication in a refrigerant atmosphere. In this connection, Patent Literature 3 discloses a use of grease containing $MoS_2$ in a liquid refrigerant lubrication. However, the composition of the main component of the grease is unknown.

CITATION LIST

Patent Literature(s)

Patent Literature 1: JP-A-2010-090285
Patent Literature 2: JP-A-2008-239815
Patent Literature 3: JP-A-05-005491

SUMMARY OF THE INVENTION

Problems to be Solved by the Invention

Patent Literature 3 only discloses a grease containing $MoS_2$ and the composition of the main component of the grease is unknown. Thus, it is speculated that Patent Literature 3 actually entails a problem of grease elution.

An object of the present invention is to provide a bearing grease that is less eluted even in a fluorine compound refrigerant atmosphere and can keep lubricity of the bearing for a long time.

Means for Solving the Problems

After vigorous studies, the inventors have found that grease containing a specific base oil and thickener is not eluted from within a bearing in an atmosphere of a specific fluorine compound refrigerant. The invention has been reached based on the above findings.

Specifically, a bearing grease as follows is provided in an aspect of the invention.

(1) A bearing grease including: a base oil; and a thickener, in which the base oil is a base oil mixture including a polyalphaolefin and an ester, the bearing grease being used in an atmosphere of a fluorine compound refrigerant containing no hydrogen.

(2) The bearing grease according to the above aspect of the invention, in which a mass ratio of the polyalphaolefin to the ester is in a range from 5:95 to 95:5.

(3) The bearing grease according to the above aspect of the invention, in which the ester is an aromatic ester.

(4) The bearing grease according to the above aspect of the invention, in which the thickener is a urea thickener represented by the following formula (1), $$R^1NHCONHR^2NHCONHR^3 \quad (1)$$

where $R^1$ and $R^3$ respectively independently represent: a monovalent linear hydrocarbon group having 6 to 22 carbon atoms; a monovalent alicyclic hydrocarbon group having 6 to 12 carbon atoms; or a monovalent aromatic hydrocarbon group having 6 to 12 carbon atoms, and $R^2$ represents a divalent aromatic hydrocarbon group having 6 to 15 carbon atoms.

(5) The bearing grease according to the above aspect of the invention, in which 10 mass % or more of the hydrocarbon groups represented by $R^1$ and $R^3$ is occupied by a monovalent alicyclic hydrocarbon group having 6 to 12 carbon atoms.

(6) The bearing grease according to the above aspect of the invention, in which a worked penetration of the grease is in a range from 200 to 380.

(7) The bearing grease according to the above aspect of the invention, in which the fluorine compound refrigerant is at least one of $CF_3CF_2C(O)CF(CF_3)_2$ and $CF_3$—$(OC(CF_3)FCF_2)m$-$(OCF_2)n$-$OCF_3$.

(8) The bearing grease according to the above aspect of the invention, in which the fluorine compound refrigerant is $CF_3CF_2C(O)CF(CF_3)_2$.

(9) The bearing grease according to the above aspect of the invention, the bearing is used in a Rankine cycle.

(10) The bearing grease according to the above aspect of the invention, the bearing is used in a turbo Rankine cycle.

According to the bearing grease according to the above aspect of the invention, since the grease is less likely to be eluted in the predetermined fluorine compound refrigerant, the lubricity of the bearing can be kept for a long time. Further, unlike lubricating oil, since there is no need for a collecting system, the arrangement around the bearing can be made compact. Accordingly, a small, lightweight and efficient liquid refrigerant lubrication system can be designed for a Rankine cycle or a refrigeration cycle.

DESCRIPTION OF EMBODIMENT(S)

Figure 1:
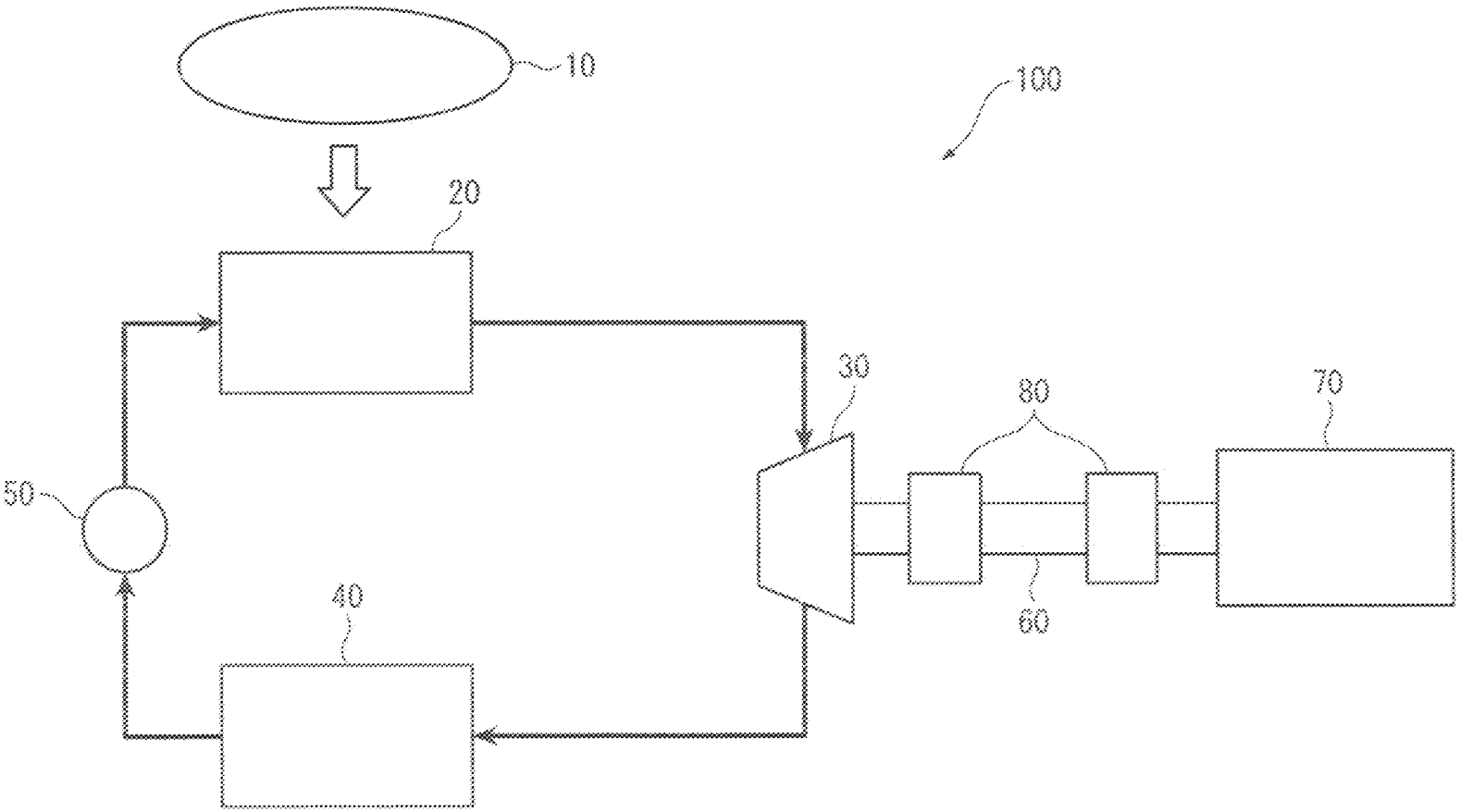
FIG. 1 schematically shows a power generator using a Rankine cycle.

A bearing grease according to the invention (sometimes referred to as "the present grease" hereinafter) includes a base oil and a thickener. The base oil is a base oil mixture containing a polyalphaolefin (sometimes referred to as "PAO" hereinafter) and an ester. The bearing grease is used in an atmosphere of a fluorine compound refrigerant containing no hydrogen. An exemplary embodiment of the invention will be described below in detail.

Base Oil

The base oil according to the exemplary embodiment of the invention contains a PAO and an ester.

The PAO is a polymer (oligomer) of alphaolefin. It is preferable that the alphaolefin (i.e. the monomer) has 6 to 20 carbon atoms in terms of viscosity index and vaporizability, more preferably 8 to 16 carbon atoms and further preferably 10 to 14 carbon atoms. Further, the PAO is preferably a dimer to pentamer of alphaolefin in terms of low vaporizability and energy saving. However, the carbon number, blend ratio and polymerization degree of alphaolefin may be adjusted in accordance with the desired properties.

Examples of usable polymerization catalyst of alphaolefin are $BF_3$ catalyst, $AlCl_3$ catalyst, Ziegler catalyst, metallocene catalyst and the like. Though the $BF_3$ catalyst is typically used for PAO having a low kinematic viscosity at 100 degrees C. of less than 30 $mm^2/s$, and $AlCl_3$ catalyst is typically used for PAO of kinematic viscosity at 100 degrees C. of 30 $mm^2/s$ or more, the $BF_3$ catalyst or the metallocene catalyst is especially preferable in terms of low vaporizability and energy saving. The $BF_3$ catalyst is used together with a promoter such as water, alcohol and ester, among which alcohol, especially 1-butanol is preferable in terms of viscosity index, low-temperature physical properties and yield rate.

Preferable examples of the ester used as the base oil are polyol ester, aliphatic diester and aromatic ester.

Examples of polyol ester include an ester of aliphatic polyhydric alcohol and linear or branched fatty acid. Examples of the aliphatic polyhydric alcohol that form this polyol ester include neopentyl glycol, trimethylolpropane, ditrimethylolpropane, trimethylolethane, ditrimethylolethane, pentaerythritol, dipentaerythritol, and tripentaerythritol. Fatty acid having 4 to 22 carbon atoms may be employed. Examples of the particularly preferable fatty acid include butanoic acid, hexanoic acid, pelargonic acid, capric acid, undecylic acid, lauric acid, myristic acid, palmitic acid, oleic acid, stearic acid, isostearic acid and tridecyl acid. Partial ester of the above-noted aliphatic polyhydric alcohol and linear or branched fatty acid may also be employed. This partial ester can be obtained by reaction of aliphatic hydric alcohol and fatty acid accompanied by suitable adjustment of a reaction mol number.

Kinematic viscosity at 100 degrees C. of the polyol ester is preferably in the range from 1 $mm^2/s$ to 50 $mm^2/s$, more preferably in the range from 2 $mm^2/s$ to 40 $mm^2/s$, and further preferably in the range from 3 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under a low temperature.

The aliphatic diester is preferably an aliphatic dibasic acid diester. A carboxylic acid content of the aliphatic dibasic acid diester is preferably linear or branched aliphatic dibasic acid having 6 to 10 carbon atoms. Specific examples include adipic acid, pimelic acid, suberic acid, azelaic acid, sebacic acid, and others that have the same property as these. An alcohol content preferably is aliphatic alcohol having 6 to 18 carbon atoms. Specific examples include hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, and isomers thereof.

Kinematic viscosity at 100 degrees C. of the aliphatic diester is preferably in the range from 1 $mm^2/s$ to 50 $mm^2/s$, more preferably in the range from 1.5 $mm^2/s$ to 30 $mm^2/s$, and further preferably in the range from 2 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under a low temperature.

Usable examples of the aromatic ester include esters of alcohol and various types of aromatic carboxylic acid such as aromatic monobasic acid, aromatic dibasic acid, aromatic tribasic acid and aromatic tetrabasic acid. Examples of aromatic dibasic acid include phthalic acid, isophtahlic acid. Examples of aromatic tribasic acid include trimellitic acid. Examples of aromatic tetrabasic acid include pyromellitic acid. Specifically, aromatic ester oil such as trimellitic acid trioctyl, trimellitic acid tridecyl and pyromellitic acid tetraoctyl is preferable.

Kinematic viscosity at 100 degrees C. of the aromatic ester is preferably in the range from 1 $mm^2/s$ to 50 $mm^2/s$, more preferably in the range from 1.5 $mm^2/s$ to 30 $mm^2/s$, and further preferably in the range from 2 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under a low temperature.

The above-noted polyol ester, aliphatic diester and aromatic ester may be respectively independently mixed in the above-mentioned PAO, may be mixed together in the PAO or may be used as a complex ester. Complex ester is an ester synthesized from polybasic acid and polyhydric alcohol, usually including monobasic acid. In the invention, complex ester favorably used may be formed from: aliphatic polyhydric alcohol; and linear or branched aliphatic monocarboxylic acid having 4 to 18 carbon atoms, linear or branched aliphatic dibasic acid, or aromatic dibasic acid, tribasic or tetrabasic acid.

Examples of aliphatic polyhydric alcohol used to form complex ester include trimethylolpropane, trimethylolethane, pentaerythritol, and dipentaerythritol. The aliphatic monocarboxylic acid may be aliphatic carboxylic acid having 4 to 18 carbon atoms, examples of which include heptadecylic acid, stearic acid, nonadecanoic acid, arachic acid, behenic acid, and lignoceric acid. Examples of aliphatic dibasic acid include succinic acid, adipic acid, pimelic acid, suberic acid, azelaic acid, sebacic acid, undecanedioic acid, dodecanedioic acid, tridecanedioic acid, carboxylic octadecane acid, carboxymethyl octadecane acid, and docosanedioic acid.

Examples of esterification reaction for producing the above-described esters include: a reaction between alcohol (e.g., monohydric or polyhydric alcohol) and carboxylic acid (e.g., monobasic acid or polybasic acid) in a predetermined ratio; partial esterification of the same and a subsequent reaction between the partially esterified material and carboxylic acid; a reaction of the acids in a reverse order; and a similar esterification reaction with mixed acids.

As described above, the base oil according to the exemplary embodiment of the invention is a base oil mixture containing PAO and ester. The mass ratio of PAO and ester in the base oil mixture is preferably in the range from 5:95 to 95:5, more preferably in the range from 50:50 to 93:7, and further preferably in the range from 70:30 to 90:10. When the ratio of PAO falls below the above range, it is likely that a large amount of base oil is eluted whereas it is also likely that a large amount of base oil is eluted when the ratio of PAO exceeds the above range.

The base oil mixture preferably exhibits a kinematic viscosity at 100 degrees C. in a range from 1 to 30 $mm^2/s$, more preferably from 2 to 20 $mm^2/s$. When the kinematic viscosity at 100 degrees C. is 1 $mm^2/s$ or more, excellent lubricity can be obtained and evaporation loss is small. When the kinematic viscosity at 100 degrees C. is 30 $mm^2/s$ or less, energy loss due to viscosity resistance is restricted, thereby improving start-up performance and rotational performance under a low temperature.

Known viscosity improver or viscosity index improver may be blended in the base oil in a range of 10 mass % or less based on the total amount of the grease. Examples of the viscosity improver or viscosity index improver include olefin oligomer such as polybutene, polyisobutylene and co-oligomer of 1-decene and ethylene, olefin copolymer (OCP), polymethacrylate and hydrogenated styrene-isoprene copolymer. It is preferable that the properties of the base oil stay in the above range when the viscosity improver or viscosity index improver is blended.

A urea compound is preferable as the thickener blended in the base oil because the urea compound is excellent in the lubricity of the bearings and is capable of restraining elution of the base oil. Examples of the urea compound include monourea compound, diurea compound, triurea compound and tetraurea compound. However, diurea compound is especially preferable in terms of lubricity of bearings.

The diurea compound may be exemplified by a compound represented by the following formula (1).

$$R^1NHCONHR^2NHCONHR^3 \quad (1)$$

In the formula (1), $R^1$ and $R^3$ respectively independently represent: a monovalent chain hydrocarbon group having 6 to 22 carbon atoms, preferably 10 to 22 carbon atoms, further preferably 15 to 22 carbon atoms, a monovalent alicyclic hydrocarbon group having 6 to 12 carbon atoms, preferably 6 to 8 carbon atoms; or a monovalent aromatic hydrocarbon group having 6 to 12 carbon atoms, preferably 6 to 9 carbon atoms. $R^2$ represents a divalent aromatic hydrocarbon group having 6 to 15 carbon atoms.

Examples of the divalent aromatic hydrocarbon group represented by $R^2$ in the formula (1) are phenylene group, diphenyl methane group and tolylene group.

Further, examples of the monovalent chain hydrocarbon group having 6 to 22 carbon atoms represented by $R^1$ and $R^3$ include a linear or branched and saturated or unsaturated alkyl group, examples of which include linear and branched alkyl groups such as hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, octadecenyl groups, nonadecyl groups and icodecyl groups.

Examples of the monovalent alicyclic hydrocarbon group represented by $R^1$ and $R^3$ in the formula (1) having 6 to 22 carbon atoms are cyclohexyl group or alkyl-group-substituted cyclohexyl groups having 7 to 12 carbon atoms, examples of which include, in addition to cyclohexyl group, methyl cyclohexyl groups, dimethyl cyclohexyl groups, ethyl cyclohexyl groups, diethyl cyclohexyl groups, propyl cyclohexyl groups, isopropyl cyclohexyl groups, 1-methyl-propylcyclohexyl group, butyl cyclohexyl groups, amyl cyclohexyl group, amyl-methyl cyclohexyl group and hexyl cyclohexyl group. Among the above, cyclohexyl group, methyl cyclohexyl group and ethyl cyclohexyl group are preferable in terms of production convenience.

Examples of the monovalent aromatic hydrocarbon group represented by $R^1$ and $R^3$ in the formula (1) having 6 to 12 carbon atoms are phenyl group, toluoyl group, benzyl group, ethylphenyl group, methylbenzyl group, xylyl group, propylphenyl group, cumenyl group, ethylbenzyl group, methylphenetyl group, butylphenyl group, propylbenzyl group, ethylphenetyl group, pentylphenyl group, buthylbenzyl group, propylphenetyl group, hexylphenyl group, pentylbenzyl group, butylphenetyl group, heptylphenyl group, hexylbenzyl group, pentylphenetyl group, octylphenyl group, butylbenzyl group, hexylphenetyl group, nonylphenyl group and octylbenzyl group.

Though the content of hydrocarbon groups in $R^1$ and $R^3$ (terminal groups of the diurea compound) (i.e. the composition of material amine (or mixed amine) for forming $R^1$ and $R^3$) is not specifically limited, an amine having a chain hydrocarbon group or an alicyclic hydrocarbon group or a mixture thereof is preferable in order to restrain elution.

Especially, in order to restrain elution, it is preferable that 10 mass % or more of the hydrocarbon groups represented by $R^1$ and $R^3$ in the formula (1) is occupied by a monovalent alicyclic hydrocarbon group having 6 to 12 carbon atoms. The above ratio is preferably 30 mass % or more, more preferably 50 mass % or more.

The diurea compound can be usually obtained by reacting diisocyanate and monoamine. Examples of diisocyanate are diphenylenediisocyanate, 4,4'-diphenylmethanediisocyanate and tolylenediisocyanate, among which diphenylmethanediisocyanate is preferable in view of low harmful effect thereof. Examples of the monoamine are amines corresponding to the chain hydrocarbon group, alicyclic hydrocarbon group and aromatic hydrocarbon group represented by $R^1$ and $R^3$ in the above formula (1). Examples of the amines include chain hydrocarbon amines such as octyl amine, dodecyl amine, octadecyl amine and octadecenyl amine, alicyclic hydrocarbon amines such as cyclohexyl amine, aromatic hydrocarbon amines such as aniline and toluidine and mixed amines in which these amines are mixed.

The monoamine used for producing the diurea compound preferably include 80 mass % or more of aliphatic amine having 4 to 22 carbon atoms, more preferably 6 to 20 carbon atoms, based on the total amount of the monoamine in order to prevent elution of the base oil into refrigerant. The aliphatic monoamine having carbon atoms within the above range is more preferably contained by 50 mass % or less, further more preferably by 30 mass % or less. In addition, among the above aliphatic amine, aliphatic amine preferably occupies 60 mass % or more, more preferably 80 mass % or more aliphatic amine having 6 to 20 mass % of carbon atoms.

The content of the thickener is not limited as long as the thickener can form and keep the form of grease together with the base oil. However, in view of fluidity and low-temperature properties of the grease, the content of the thickener is preferably in a range from 5 to 25 mass %, more preferably from 10 to 20 mass % based on the total amount of the grease.

The thickener used in the grease according to the exemplary embodiment of the invention is for applying consistency to the grease. When the content of the thickener is too small, desired penetration (consistency) cannot be obtained.

On the other hand, when the content of the thickener is too large, the lubricity of the grease is deteriorated.

In addition, worked penetration of the grease is preferably in a range from 150 to 375, more preferably in a range from 200 to 340 (according to JIS K2220.7). When the worked penetration is 150 or more, the grease is not so hard that excellent low-temperature start-up performance can be obtained. On the other hand, when the worked penetration is 375 or less, the grease is not too soft to impair lubricity.

The grease is used in an atmosphere of fluorine compound refrigerant containing no hydrogen. Examples of the fluorine compound refrigerant include a fluorine compound or a saturated fluorocarbon compound represented by the following molecular formula (A), $$CpOqFrRs \quad (A)$$

where: R represents Cl, Br or I; p is an integer of 1 to 8; q is an integer of 2 or less; r is an integer of 1 to 18; and s is an integer of 17 or less, with a proviso that when q is 0, p is an integer of 2 to 8 and one or more unsaturated carbon-carbon bond is contained in the molecule.

The molecular formula (A), which shows types and numbers of elements in the molecule, represents a fluorine compound in which the number p of carbon atoms C is 1 to 8. Any fluorine compound having 1 to 8 carbon atoms possesses physical and chemical properties such as a boiling point, a freezing point and an evaporative latent heat required for a refrigerant. In order to obtain further preferable properties, p is preferably in a range from 1 to 6.

In the molecular formula (A), the bonding configurations of p carbon atoms represented by $C_p$ include carbon-carbon single bond, unsaturated bond such as carbon-carbon double bond, carbon-oxygen double bond and the like. Unsaturated carbon-carbon bond is preferably carbon-carbon double bond in terms of stability. While the number of unsaturated carbon-carbon bond is 1 or more, the number is preferably 1.

In the molecular formula (A), the bonding configurations of q oxygen atoms represented by $O_q$ are preferably derived from an ether group, a hydroxyl group or a carbonyl group. The number q of oxygen atoms may be 2, which is also true of when two ether groups, hydroxyl groups or the like are contained.

On the other hand, when q is 0 (i.e., no oxygen atom is contained in the molecule), p is in a range from 2 to 8 and one or more unsaturated bond such as carbon-carbon double bond is contained in the molecule. In other words, at least one of the bonding configurations of p carbon atoms represented by $C_p$ is required to be unsaturated carbon-carbon bond.

In the formula (A), R represents Cl, Br or I.

As described above, preferable examples of the fluorine compound represented by the molecular formula (A) are an unsaturated fluorocarbon compound, a fluoroether compound and a fluoroketone compound. Other example of the fluorine compound refrigerant is a saturated fluorocarbon compound.

The above compounds will be described below.

Fluoroether Compound

Examples of the fluoroether compound usable as a refrigerant in this exemplary embodiment include a fluorinated compound of chain aliphatic ether having 2 to 6 carbon atoms, 1 to 2 ether bonds and linear or branched alkyl groups, a fluorinated compound of alicyclic ether having 3 to 6 carbon atoms and 1 to 2 ether bonds, a polymer of fluorinated propylene oxide, a polymer of fluorinated ethylene oxide and a copolymer of fluorinated propylene oxide and fluorinated ethylene oxide.

Specifically, examples of such a fluoroether compound are dimethyl ether implanted with 6 fluorine atoms, methylethyl ether implanted with 8 fluorine atoms, dimethylether implanted with 10 fluorine atoms, dimethoxymethane implanted with 8 fluorine atoms, methylpropyl ethers implanted with 10 fluorine atoms, methylbutyl ethers implanted with 12 fluorine atoms, ethylpropyl ethers implanted with 12 fluorine atoms, oxetane implanted with 6 fluorine atoms, 1,3-dioxolane implanted with 6 fluorine atoms, tetrahydrofuran implanted with 8 fluorine atoms, a polymer of perfluoropropylene oxide, a polymer of perfluoroethylene oxide and a copolymer of perfluoropropylene oxide and perfluoroethylene oxide.

Further specific examples of the fluoroether compound are hexafluorodimethyl ether, perfluorodimethoxymethane, perfluorooxetane, perfluoro-1,3-dioxolane and $CF_3$—$(OC(CF_3)FCF_2)m$-$(OCF_2)n$-$OCF_3$ (boiling point 55 degrees C.) (manufactured by Solvay Solexis K.K. Galden HT55).

Among the above, $CF_3$—$(OC(CF_3)FCF_2)m$-$(OCF_2)n$-$OCF_3$ is preferable in view of appropriate boiling point thereof.

In the exemplary embodiment of the invention, one of the fluoroether compounds may be singularly used or a combination of two or more thereof may be used.

Fluoroketone Compound

A preferable example of the fluoroketone compound to be used as a refrigerant is a fluorinated compound of aliphatic ketone having 3 to 8 carbon atoms, preferably having 3 to 6 carbon atoms, in which the alkyl group is linear or branched.

More specifically, examples of such a fluoroketone compound are acetone implanted with 6 fluorine atoms, methylethyl ketone implanted with 8 fluorine atoms, diethyl ketone implanted with 10 fluorine atoms, methylpropyl ketones implanted with 10 fluorine atoms and ethylpropyl ketones implanted with 12 fluorine atoms.

Further specific examples of the fluoroketone compound are hexafluorodimethyl ketone, perfluoromethylethyl ketone and $CF_3CF_2C(O)CF(CF_3)_2$ (boiling point 49 degrees C.) (manufactured by 3M Company, NOVEC649).

Among the above, $CF_3CF_2C(O)CF(CF_3)_2$ is preferable in view of appropriate boiling point thereof.

According to this exemplary embodiment of the invention, one of the fluoroketone compounds may be singularly used or a combination of two or more thereof may be used.

Examples of the bearing to which the present grease is to be applied are angular ball bearings, deep groove ball bearings, self-aligning ball bearings and thrust ball bearings, among which angular ball bearings that are advantageous for size reduction and speed-up and are frequently used as bearings for turbomachines are preferable.

With the use of the present grease, since only a little amount of grease is eluted to the fluorine compound refrigerant, the lubricity of the bearings can be maintained for a long time. Further, the grease often does not require a collecting system and a reservoir as required in lubricating oil and the arrangement around the bearing can be made compact. Accordingly, the present grease can be easily applied to energy recovery equipment using a Rankine cycle (e.g. turbomachine). Such energy recovery equipment is suitably used in various industrial machineries (in a chemical plant, petroleum refining plant, steel plant, machinery manufacturing plant and heat treat plant) and automobiles.

An application example of a bearing in which the present grease is applied will be described below.

FIG. 1 schematically shows a power generator 100 using a Rankine cycle. In the Rankine cycle, vapor of a refrigerant is generated at an evaporator 20 using heat from a waste heat source 10 of an engine or various industrial machineries to rotate an impeller of a power generating turbine 30. The refrigerant having passed through the power generating turbine 30 is liquefied at a condenser 40 and is re-introduced to the evaporator 20 by a pump 50 to be circulated in the system. A shaft 60 is connected to the impeller of the power generating turbine 30 to be rotated therewith to generate electric power by a power generating unit 70. The shaft 60 is rotatably held by a bearing 80. The present grease is used in the bearing 80.

The present grease may be added as necessary with other additives such as an antioxidant, a rust inhibitor, a solid lubricant, a filler, an oiliness agent, a metal deactivator, a water resisting agent, an extreme pressure agent, an antiwear agent, a viscosity index improver and coloring agent as long as effects of the present invention are not hampered.

Examples of the extreme pressure agent are thiocarbamates such as zinc dialkyldithiophosphate, molybdenum dialkyldithiophosphate, ashless dithiocarbamate, zinc dithiocarbamate and molybdenum dithiocarbamate, sulfur compound (sulfurized fat and oil, sulfurized olefin, polysulfide, sulfurized mineral oil, thiophosphates, thioterpenes and dialkylthiodipropionates), phosphates and phosphites (tricresyl phosphate and triphenyl phosphite). The oiliness agent may be exemplified by alcohols, carboxylic acids, glycerides and esters. The content of the above additive is preferably approximately in a range from 0.1 mass % to 5 mass % of the total amount of the grease.

Examples of the antioxidant are: amine antioxidants such as alkylated diphenylamine, phenyl-alpha-naphthylamine, and alkylated phenyl-alpha-naphthylamine; phenol antioxidants such as 2,6-di-t-butyl-4-methylphenol and 4,4'-methylenebis(2,6-di-t-butylphenol); and peroxide decomposer such as sulfur-based antioxidants and ZnDTP. The content of the antioxidant is usually in a range from 0.05 mass % to 10 mass %.

Examples of the rust inhibitor are benzotriazole, zinc stearate, succinates, succinic acid derivative, thiadiazole, benzotriazole, benzotriazole derivative, sodium nitrite, petroleum sulfonate, sorbitan monooleate, fatty acid soap and amine compounds.

Examples of the solid lubricant are polyimide, PTFE, graphite, metal oxide, boron nitride, melaminecyanurate (MCA) and molybdenum disulfide.

EXAMPLE(S)

Next, the invention will be further described in detail with Examples and Comparatives, which by no means limit the scope of the invention.

Example 1 and Comparatives 1 to 4

The greases according to Example(s) and Comparatives were prepared according to the composition shown in Table 1, of which elution characteristics of the greases from the base oil were evaluated while the greases were in contact with four fluorine compound refrigerants. Evaluation results are also shown in Table 1.

TABLE 1

| | | | | | | | |
|---|---|---|---|---|---|---|---|
| Grease Composition (mass %) | Base Oil | PAO (*1) | — | Remnant | | — | — |
| | | Trimellitic Acid Trioctyl | — | — | Remnant | — | — |
| | | Pentaerythritol Tetranonyl Ester | — | — | — | Remnant | — |
| | | Base Oil Mixture of PAO, Trimellitic Acid Trioctyl and Viscosity Improver (*2) | Remnant | — | — | — | Remnant |
| | Thickner | Urea Compound (*3) | 15.0 | 15.0 | 15.0 | 15.0 | 15.0 |
| | Antioxidant | Dioctyldiphenyl amine | 1.0 | 1.0 | 1.0 | 1.0 | 1.0 |
| | Rust-Inhibitor | Succinates | 0.1 | 0.1 | 0.1 | 0.1 | 0.1 |
| | (Total) | | 100.0 | 100.0 | 100.0 | 100.0 | 100.0 |
| Grease Properties | | Work Penetration | 261 | 218 | 243 | 222 | 261 |
| Refrigerant Contact Test (Base Oil Separation Ratio %) | A: $CF_3CF_2C(O)CF(CF_3)_2$ (*4) | | 0 | 15 | — | — | — |
| | B: $CF_3$—$(OC(CF_3)FCF_2)_m$—$(OCF_2)_n$—$OCF_3$ (*5) | | 0 | 22 | 31 | — | — |
| | C: $C_4F_9OCH_3$ (*6) | | — | 28 | — | — | 53 |
| | D: $CF_3CH_2OCF_2CHF_2$ (*7) | | — | 27 | — | 30 | 20 |

*1 PAO (Poly-AlphaOlefin) Kinematic viscosity at 40 degrees C.; 46.7 $mm^2/s$, Kinematic viscosity at 100 degrees C.; 7.8 $mm^2/s$, Viscosity Index 137

*2 Base Oil Mixture: Prepared by mixing the above PAO, trimellitic acid trioctyl and a viscosity improver (manufactured by Mitsui Chemicals, Inc. Lucant HC-2000) at a mass ratio of 79:16:5 under a room temperature.

*3 Urea Compound: Manufactured as follows (simultaneously with grease). Initially, a component (a) in which to-be-used amount of diphenylmethane-4,4'-diisocyanate was dissolved by heating in a half of the base oil to be used was prepared. Next, a component (b) in which mixed amine (mixture of octadecylamine and cyclohexylamine at a mole ratio of 20:80) of double molar amount relative to the amount of the diphenylmethane-4,4'-diisocyanate was dissolved by heating in the remaining half of the base oil was prepared. Then, the above (a) and (b) were mixed to cause a reaction. Subsequently, the mixture of the (a) and (b) was stirred while heating and was kept stirring for an hour while keeping the temperature of the mixture after the temperature of the mixture reached 160 degrees C.. Then, the mixture was cooled to 80 degrees C. at a rate of 50 degrees C. per an hour. The cooled mixture was added with an antioxidant and rust inhibitor and was subjected to milling process and defoaming process to obtain grease.

*4 Refrigerant A: $CF_3CF_2C(O)CF(CF_3)_2$ (boiling point 49 degrees C.) (manufactured by 3M Company, NOVEC649)

*5 Refrigerant B: $CF_3$—$(OC(CF_3)FCF_2)$m—$(OCF_2)$n—$OCF_3$ (boiling point 55 degrees C.) (manufactured by Solvay Solexis K.K. Galden HT55)

*6 Refrigerant C: $C_4F_9OCH_3$ (boiling point 61 degrees C.) (manufactured by 3M Company, HFE7100)

*7 Refrigerant D: $CF_3CH_2OCF_2CHF_2$ (boiling point 56 degrees C.) (manufactured by ASAHI GLASS CO., LTD. ASAHIKLIN AE3000)

Evaluation Method (1) Worked Penetration

Consistency was measured according to JIS K 2220.7.

(2) Elution Characteristics of Grease (Refrigerant Contact Test)

After preparing each of the greases using the base oil, the thickener and the additives shown in the above tables, the elution characteristics of the base oil of the grease into the refrigerant were evaluated according to a "grease evaluation method" disclosed in JP-A-2010-151016, which specifically was conducted as follows.

Figure 2:
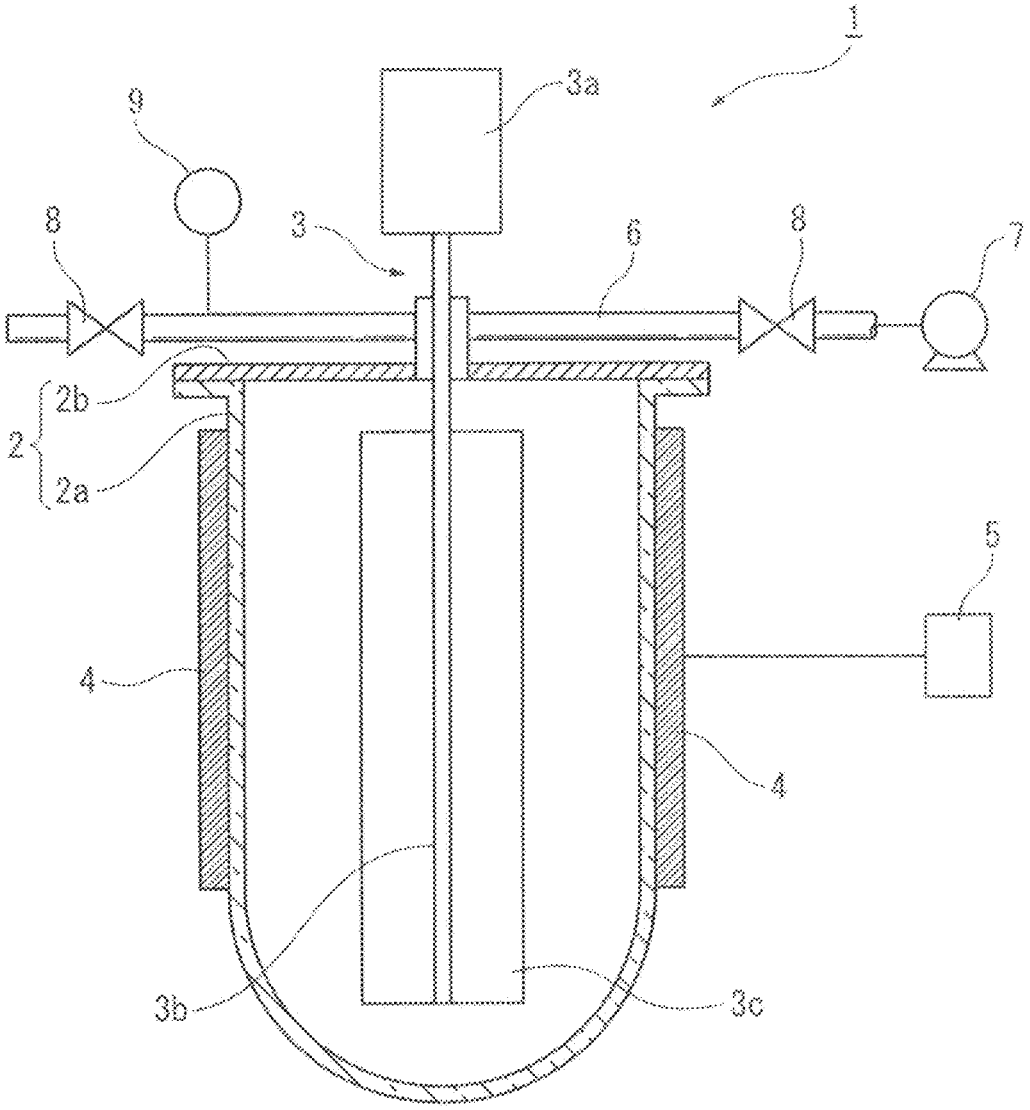
FIG. 2 schematically shows a separation evaluation apparatus according to Example(s).
Figure 3A:
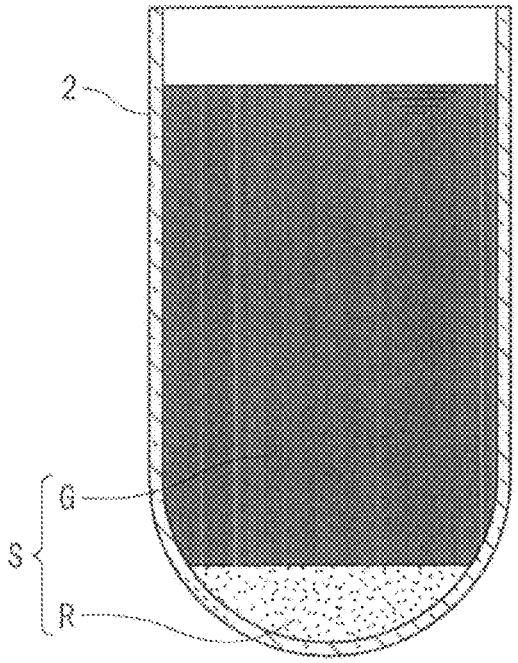
FIG. 3A illustrates an evaluation sample held in a separation bath in Example(s).
Figure 3B:
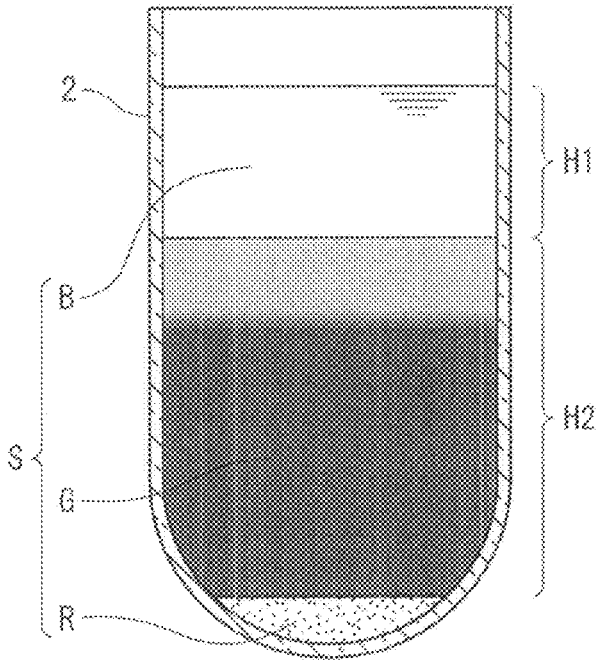
FIG. 3B illustrates the evaluation sample after being subjected to temperature cycling process in Example(s), in which base oil is separated from a diluted grease.

For each of greases to be evaluated, the base oil used as a component of the grease was separately prepared. The grease and the base oil were collected at a mass ratio of 1:20 and were sufficiently mixed with a homogenizer. Subsequently, 50 g of the diluted grease and 9 g of the evaluation target refrigerant were put into a transparent container (FIG. 2) of which interior had been washed in advance. The transparent container was covered with a cover 2*b* to keep the interior thereof hermetically sealed. At this time, as shown in FIG. 3A, though the evaluation sample S was separated into a layer of the evaluation target refrigerant R and a layer of the diluted grease G, the base oil in the component of the diluted grease G was not separated but remained in the layer of the diluted grease G. It should be noted that valves 8 of a pipe 6 provided to the cover 2*b* were closed. Subsequently, an interior of a separation bath 2 was agitated with an agitation fin 3*c* to uniformly mix the diluted grease and the evaluation target refrigerant to provide an evaluation sample. Then, while continuing the agitation, a set of cycle operations (two hours at room temperature and two hours at 110 degrees C.) were repeated for six times, resulting in an experiment for total twenty four hours. Thereafter, the mixture was laid still for twenty four hours at a room temperature to stabilize the evaluation sample. Then, as shown in FIG. 3B, a base oil B and an evaluation target refrigerant R were separated.

At this time, a ratio of the layer of the base oil B separated from the diluted grease G was measured to calculate a base oil separation ratio. Specifically, a height H1 of the layer of the separated base oil B and a height H2 of the layer of the diluted grease G were directly measured from an outside of the transparent separation bath 2 shown in FIG. 3B with a measure or the like. The base oil separation ratio was calculated based on the obtained measurement values according to the following formula.

$$\text{Base oil separation ratio}=\{H1/(H1+H2)\}\times 100$$

Practically, it is preferable that the base oil separation ratio is 15% or less, more preferably 10% or less, ideally 0%.

Evaluation Results

As shown in the results in Table 1, the bearing grease according to the Examples of the invention contained the predetermined base oil mixture and the predetermined thickener and was used in an atmosphere of specific fluorine compound refrigerant (refrigerant A, refrigerant B), the base oil separation ratio is virtually 0%. Accordingly, it can be understood that the lubricity can be maintained for a long time when the base oil of the invention is used in a bearing in the refrigerant atmosphere. In contrast, since the base oil of each of the greases according to Comparatives 1 to 3 was not the predetermined base oil mixture, all of the greases according to Comparatives 1 to 3 exhibited high base oil separation ratios. Further, though Comparative 4 uses the predetermined base oil mixture of the invention, since a different refrigerant (refrigerant C and refrigerant D including hydrogen) was used, Comparative 4 exhibited a high base oil separation ratio. Thus, it is difficult to use the grease according to each of the Comparatives to a bearing in a fluorine compound refrigerant atmosphere.

The invention claimed is:

1. A bearing grease, comprising:

a base oil;

a thickener;

an antioxidant; and a rust inhibitor, wherein the base oil is a base oil mixture comprising a polyalphaolefin and an aromatic ester, the bearing grease is in an atmosphere of a fluorine compound refrigerant comprising no hydrogen, a mass ratio of the polyalphaolefin to the aromatic ester in the base oil mixture is 50:50 to 93:7, the thickener is a urea thickener of formula (1):

$$R^1NHCONHR^2NHCONHR^3 \quad (1)$$

wherein $R^1$ and $R^3$ are each independently a monovalent linear hydrocarbon group having 6 to 22 carbon atoms, a monovalent alicyclic hydrocarbon group having 6 to 12 carbon atoms, or a monovalent aromatic hydrocarbon group having 6 to 12 carbon atoms, and $R^2$ is a divalent aromatic hydrocarbon group having 6 to 15 carbon atom, and wherein 10 mass % or more of hydrocarbon groups $R^1$ and $R^3$ is a monovalent alicyclic hydrocarbon group having 6 to 12 carbon atoms.

2. The bearing grease according to claim 1, wherein a worked penetration of the grease is from 200 to 380.

3. The bearing grease according to claim 1, wherein the fluorine compound refrigerant is at least one selected from the group consisting of $CF_3CF_2C(O)CF(CF_3)_2$ and $CF_3$—$(OC(CF_3)FCF_2)m$-$(OCF_2)n$-$OCF_3$.

4. The bearing grease according to claim 3, wherein the fluorine compound refrigerant is $CF_3CF_2C(O)CF(CF_3)_2$.

5. The bearing grease according to claim 1, wherein the bearing is in a Rankine cycle.

6. The bearing grease according to claim 5, wherein the bearing is in a turbo Rankine cycle.

7. The bearing grease according to claim 1, wherein the fluorine compound refrigerant comprises $CF_3CF_2C(O)CF(CF_3)_2$.

8. The bearing grease according to claim 1, wherein the fluorine compound refrigerant comprises at least one fluoroether.

9. The bearing grease according to claim 1, wherein the fluorine compound refrigerant comprises at least one hexafluorodimethyl ether, perfluorodimethoxymethane, perfluorooxetane and perfluoro-1,3-dioxolane.

* * * * *